US005471748A

United States Patent [19]

Provost

[11] Patent Number: 5,471,748

[45] Date of Patent: Dec. 5, 1995

[54] CUTTING GUIDE FOR THE REMOVAL OF A HANDGRIP FROM THE SHAFT OF A GOLF CLUB

[76] Inventor: Richard A. Provost, 350 Meadow St., Apt. 58, Agawam, Mass. 01001

[21] Appl. No.: 241,293

[22] Filed: May 11, 1994

[51] Int. Cl.[6] ..... A63B 57/00; B26B 29/06

[52] U.S. Cl. ..... 30/289; 33/42; 33/484; 273/32 B

[58] Field of Search ..... 30/90.4, 90.6, 30/90.7, 90.8, 289, 457–461; 273/32 B; 33/42, 484, 485

[56] References Cited

U.S. PATENT DOCUMENTS 3,533,313 10/1970 Matthews ..... 30/457

*Primary Examiner*—Douglas D. Watts

*Attorney, Agent, or Firm*—Chapin, Neal & Dempsey

[57] ABSTRACT

A cutting guide is provided to assist in the removal of a handgrip from the shaft of a golf club. The guide includes a conical, tubular member adapted to receive the handgrip therein. The guide has a lateral opening that extends over the length thereof and its lateral dimension is of sufficient width to enable the handgrip to fit therein but such as to ensure a snug fit between the guide and the handgrip when disposed in coextensive relation therewith. The opening, including at least one edge thereof, comprising a radially extending portion to provide a guide for movement of the blade of a cutting tool when disposed thereagainst.

8 Claims, 1 Drawing Sheet

CUTTING GUIDE FOR THE REMOVAL OF A HANDGRIP FROM THE SHAFT OF A GOLF CLUB

FIELD OF THE INVENTION

This invention relates to golf club equipment and more specifically a cutting guide adapted to be removably fitted onto the worn handgrips of golf clubs to assist in removal thereof for regripping the clubs.

BACKGROUND OF THE INVENTION

Handgrips of golf clubs must be periodically replaced when they become old and worn. In replacing the handgrips or "regripping" a set of golf clubs, the first task is the removal of the old or worn handgrips. Most handgrips available today are in the form of unitary sleeves open at one end for being telescopically fitted onto the shaft of golf clubs and which are more or less permanently bonded or cemented onto the shaft. In stripping or removing such handgrips from the club shafts, the first step generally involves cutting longitudinally through the leather, rubber or composite material of which most handgrips are presently formed. The handgrip is usually cut from end-to-end over its full length after which it can be stripped or peeled from the shaft and in most cases if properly done, there will be only a small residue of the bonding agent that remains on the shaft which can be easily removed by using the appropriate solvent.

During such cutting and stripping operations, the golf club may be either clamped in a bench vise or hand held. The cutting operation usually involves the use of a knife having a sharp blade which, in combination of sufficient downward pressure being exerted on the knife, is capable of cutting clean through the handgrip material. As a result, the blade, if properly used, will cut radially through the handgrip material down to the shaft. With the shaft being round in cross-section, there is a tendency, when attempting to cut through the handgrip, for the blade to slip laterally to one side or the other depending on the direction and force involved. In such cases, the user may suffer, at best, a work delay in repositioning the blade at the point of the cut where the knife slipped from the work or, at worst, a traumatic injury. For instance, the person's workhand might forcefully impact against some hard and immovable object in the vicinity of the work or if the worker's free arm or other part of the person's body should happen to be in the path of the blade when such a slip occurs, a serious wound or cut may result thereby requiring first aid or even medical attention. The tendency for accidents to occur is inversely proportional to the skill, dexterity and care being exercised by the worker and more or less directly proportional to the speed and the number of shafts to be regripped and the amount of time available to complete the work. Since club regripping usually involves a full set of clubs and the basis for the charges is a set dollar amount, e.g., $4.00 per club, including the cost of the handgrip, it is important that the job be expeditiously completed without any untoward incidents.

Traditionally, most golf club facilities have not used any cutting aides in club regripping work although a blade-holding cutting tool has recently found some acceptance in the golf trade for regripping golf clubs. That cutting tool includes a slotted planar base through which a special blade retractably extends. At one side edge of the base, a skirt extends downward and is adapted to engage one side surface of the handgrip when disposed in cutting relation on the handgrip to be stripped from the shaft of a golf club. A tubular handle is disposed at the upper edge of the tool. When the tool is being used, the blade is adjusted to extend below the base a distance sufficient to slice through the thickest portion of the handgrip. The cutting device is then placed with its planar base against the upper surface of the handgrip at a point adjacent the butt end thereof and while pressing the cutter downwardly, it is slid along the length of the handgrip with the skirt slidably disposed against the side of the handgrip as the blade slices thereinto.

One of the drawbacks of using this device is that when the blade is set for cutting through the thicker end of the handgrip, the tip of the blade will necessarily extend so far below the base that its lower surface will not make surface-to-surface or flush contact with the handgrip. As a result of the blade extension being set or fixed for each cutting operation while the thickness of each handgrip decreases from the butt end of the handgrip toward the inner end thereof, the cutting tool is relatively unstable while cutting over the full length of the handgrip and becomes more unstable when cutting through the thinner portion of the handgrip. In addition, that cutting tool is limited to using only blades especially adapted to be fitted into the holder.

SUMMARY OF THE INVENTION

Accordingly, it is the general object of the present invention to provide a cutting guide adapted for the efficient, expeditious and safe removal of handgrips from golf clubs.

It is a further object to provide a cutting guide which may be used by left or right-handed persons.

It is yet another object to allow the user to slice through the handgrip using any one of a variety of blade-holding cutting tools or knives.

It is another object to provide a cutting guide adaptable to any size handgrip.

According to the present invention, a cutting guide is adapted for removal of a handgrip of a golf club in the form of a semi-conical tubular member or sleeve having a longitudinal slot or opening that extends over the full length of the member. The guide has a length and taper comparable to that of maximum size handgrips so as to fit snugly thereon. The slot is of sufficient lateral dimension to enable the upper end of the guide to be fitted onto handgrips at some point intermediate the upper and lower ends of the handgrips. The guide may then be moved longitudinally upward over the handgrip until it fits snugly thereon and in that condition, the upper end of the guide will extend beyond the butt end of the handgrip. At least one edge of the slot includes a radially extending flange or lip portion adapted to be engaged by and to serve as a guide for the blade of a cutting implement.

The above and other objects and advantages of this invention will become more readily apparent when the following description is read in conjunction with the accompanying drawings.

DETAILED DESCRIPTION OF THE PREFERRED EMBODIMENTS

Figure 1:
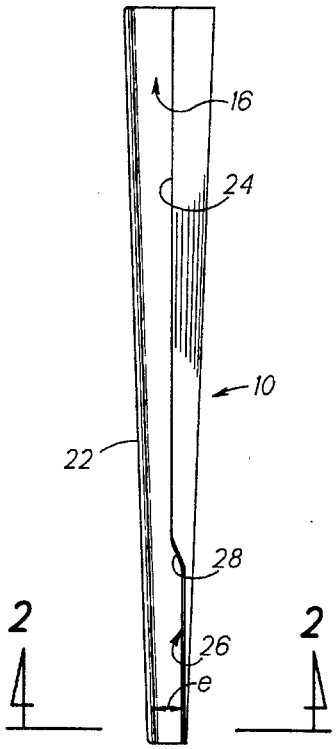
FIG. 1 is an elevational view of a cutting guide of the type embodying the present invention.

In the drawings, a tubular cutting guide 10 embodying this invention for fitting onto handgrips is illustrated at 11 and is disposed on the upper end of the shaft 12 of a golf club 13 in the usual manner. The handgrip 11 is of generally conical configuration and the shaft of the golf club also tapers in diameter either uniformly or in a plurality of steps of decreasing diameter from the upper to the lower end of the shaft.

Figure 3:
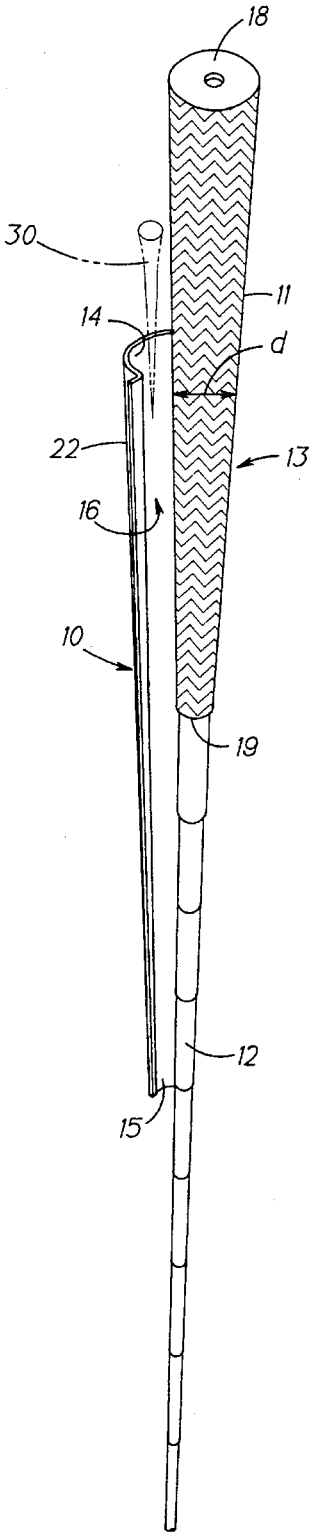
Figure 4:
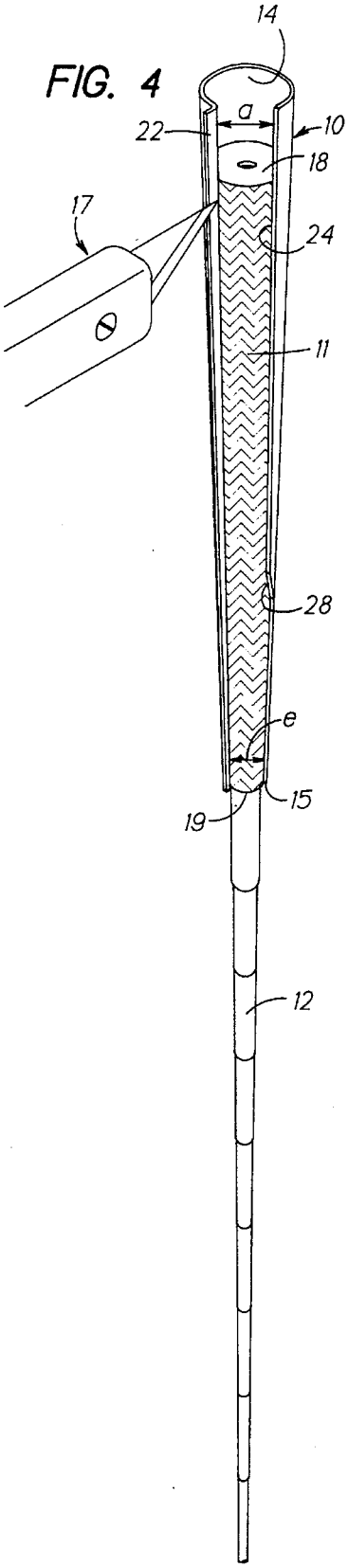

The cutting guide 10 is generally a unitary tubular member or sleeve that is preferably of semi-conical configuration, open at both ends thereof, as best shown at 14 and 15 in FIG. 3 and the guide 10 further includes a longitudinal slot 16 that extends from end-to-end of the guide. The slot is generally tapered in proportion to the taper of the conical cutting guide 10 and the guide is dimensioned to fit snugly, as depicted in FIG. 4, when disposed in generally coextensive relationship on any various sizes and types of golf club handgrips, as illustrated at 11. The guide is preferably formed of rigid, hard and durable sheet material, such as a suitable metal. Eighteen gauge stainless steel or an equivalent material has been found to provide the necessary rigidity and hardness to prevent the guide from being damaged by a blade of a cutting tool 17 when used, as shown in FIG. 4, for cutting through the handgrip in the stripping process.

The length of the guide 10 may be on the order of twelve inches so that it will be at least as long as or preferably somewhat longer than conventional handgrips. The result of this arrangement is that the upper edge 14 of the guide will be adjacent to or above the butt end 18 of the handgrip 11 when the lower edge 15 of the guide will be at or below the lower edge 19 of the handgrip. The inner cross-sectional surface of the guide 10 is preferably of conical configuration and dimensions for snugly engaging the generally conical outer surface of the average, or regular, and/or jumbo size handgrips 11. This arrangement ensures that when the guide is disposed on the handgrip in coextensive relation therewith, the frictional forces at the interface of the handgrip and cutting guide will be sufficient so that the guide will remain in fixed-relation during the cutting operation, which will hereinafter be more fully described.

Figure 2:
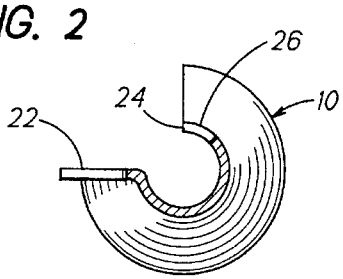
FIG. 2 is sectional view of the cutting guide taken along line 2—2 of FIG. 1, and FIGS. 3 and 4 are elevational views illustrating the fitting of the cutting guide onto a handgrip to be stripped from the shaft of a golf club.

The slot 16 of the guide 10 longitudinally extends the length thereof having one edge 22 thereof that is defined by a lip or radially extending flange and an opposing edge 24 (FIG. 2) that is defined by the inner and outer conical surfaces of the guide. The lower portion 26 of the edge 24 is stepped outwardly as at 28 so that at its lower end 15, the width of the slot will be approximately the same as the width of the slot at a point intermediate the length of the guide. The edge 24 of step 28 is preferably beveled or flared, as shown, so that there are no sharp corners which may have a tendency to catch on the handgrip 11.

The lateral dimension or width a (FIG. 4) of the slot 16 at or adjacent to the upper end of the guide is made approximately equal to diameter d (FIG. 3) of the handgrip which is also approximately the same as the width e (FIG. 1) of the slot at the lower end 15 of the guide. This dimensional relationship of the guide 10 to the handgrip 11 and the shaft 12 of the golf club 13 enables the guide to be fitted onto the handgrip with its upper end 14 disposed at approximately at the midpoint of the handgrip. The advantage is that this can be accomplished despite the fact that the shaft may at the time be clamped in a vise at a point only inches away from the lower end 19 of the handgrip. The width of the slot 16 must also be sufficient to enable the guide to fit on men's jumbo sized handgrips. On the other hand, the slot must but sufficiently narrow to ensure that the guide fits securely and snugly about the handgrip so that there will be no tendency for it to rotate when the blade of a knife 17 is pressed against the flange 22, as best shown in FIG. 4.

For fitting the guide 10 onto the handgrip 11 of the golf club 13, the slot 16 is aligned with the grip and with the slot positioned approximately at the midpoint d of the length of the handgrip, as illustrated in FIG. 3. The handgrip is then simply fitted within the guide which then may be rotated to position the flange 22 to accommodate the user's preference, including left or right-handed persons. Once the guide 10 is properly oriented, it is longitudinally slid toward the butt end 18 of the golf club until snugly disposed on the grip. The lower end of the guide 15 when properly fitted onto the handgrip should preferably extend beyond the lower end 19 thereof, as shown in FIG. 4. When regripping ladies' clubs on which the handgrip is generally of substantially smaller girth than men's grips, a wedge-shaped shim 30 (FIG. 3), typically a golf tee, may be placed between the inner surface of the guide and the outer surface of the handgrip so that when the guide is moved toward the butt end of the club, a snug and secure fit will result with the guide properly positioned along the length of the handgrip.

After the guide 10 is properly fitted on the handgrip 11, any type of hand-held cutting tool or knife 17, as best shown in FIG. 4, may be used by placing the blade thereof against the flange 22 while moving the same along the length of the guide while exerting downward pressure on the knife. The guide is then removed by simply reversing the order in which it was fitted onto the handgrip.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A cutting guide for the removal of a handgrip disposed on an upper end portion of a golf club comprising a substantially tubular member of sheet material having a generally conical inner surface portion of predetermined taper and length which is open at opposite ends thereof and includes a slot through said sheet material and which extends longitudinally over the length of said member, the predetermined taper of said guide being such that when fitted onto a handgrip of a golf club, said guide will clamp securely onto the handgrip to hold said guide stationary thereto during use thereof, said slot includes an outwardly opening lower end portion resulting in said lower end portion having a lateral dimension comparable to the lateral dimension of said slot at a location intermediate the ends thereof enabling the upper end portion of said golf club with a handgrip thereon to be fitted through said slot and into the guide intermediate the ends thereof, and including one edge of said slot adapted to provide a guide along which a cutting tool is movable when slicing through said handgrip in the removal thereof.

2. A cutting guide for removal of a handgrip disposed on an upper end portion of a golf club, as set forth in claim 1, wherein said outward opening lower portion of said slot includes a stepped edge portion.

3. A cutting guide for removal of a handgrip disposed on an upper end portion of a golf club, as set forth in claim 1, wherein said tubular member is sufficiently rigid to maintain its form stability when fitted snugly onto the handgrip.

4. A cutting guide for removal of a handgrip disposed on an upper end portion of a golf club, as set forth in claim 1, wherein the other edge of said slot extends radially outward to form a guiding edge for said cutting tool.

5. A cutting guide for removal of a handgrip disposed on an upper end portion of a golf club, as set forth in claim 1, wherein said sheet material is metallic.

6. A cutting guide for removal of a handgrip disposed on an upper end portion of a golf club, as set forth in claim 1, wherein said sheet material is stainless steel.

7. A cutting guide for removal of a handgrip disposed on an upper end portion of a golf club, as set forth in claim 1, wherein said tubular member is of sufficient length to extend over at least the entire length of a conventional handgrip when fitted thereon.

8. A cutting guide for removal of a handgrip disposed on an upper end portion of a golf club, as set forth in claim 1, wherein said tubular member includes an inner surface having a taper comparable to that of said handgrip to maximize frictional engagement therebetween.

* * * * *